US006498329B1

(12) United States Patent
Gibernau

(10) Patent No.: US 6,498,329 B1
(45) Date of Patent: Dec. 24, 2002

(54) FOOD PRODUCTS DISTRIBUTOR

(76) Inventor: Antonio Montserrate Gibernau, C. d'Avenir, 72, 08021 Barcelona (ES)

( * ) Notice: Subject to any disclaimer, the term of this patent is extended or adjusted under 35 U.S.C. 154(b) by 0 days.

(21) Appl. No.: 09/673,201

(22) PCT Filed: Apr. 5, 1999

(86) PCT No.: PCT/ES99/00086

§ 371 (c)(1),
(2), (4) Date: Oct. 6, 2000

(87) PCT Pub. No.: WO99/53453

PCT Pub. Date: Oct. 21, 1999

(30) Foreign Application Priority Data

Apr. 8, 1998 (ES) ..... 9800759

(51) Int. Cl.[7] ..... H05B 6/64

(52) U.S. Cl. ..... 219/762; 219/753; 221/6; 221/150

(58) Field of Search ..... 219/762, 753, 219/679; 221/150 A, 150 R, 150, 6; 99/326, 327; 452/31; 177/25.14

(56) References Cited

U.S. PATENT DOCUMENTS 4,398,651 A * 8/1983 Kumpfer ..... 221/6
4,592,485 A * 6/1986 Anderson et al. ..... 221/150
5,144,879 A * 9/1992 Alessi ..... 99/327
5,168,795 A * 12/1992 Okada ..... 99/326
5,258,579 A * 11/1993 Wakasa ..... 177/25.14
5,878,910 A * 3/1999 Gibernau et al. ..... 221/150
6,139,416 A * 10/2000 Topfer ..... 452/31

* cited by examiner

*Primary Examiner*—Henry Bennett
*Assistant Examiner*—Quang Van
(74) *Attorney, Agent, or Firm*—Steinberg & Raskin, P.C.

(57) ABSTRACT

It includes a microwave oven (3) with a front door (31) that can slide vertically and a conveyor band (6) with a horizontal section extending as far as the interior of the oven; the products fall on the band by gravity from storage means (5). The oven may also have a tilting bottom (32) for expulsion of the products. The storing devices (5) are attached to a frame (4) hinged to the housing (1) and are provided with a ramp (57) for the extraction of the products through an outlet opening (55) arranged above the band (6).

The machine is compact, mechanically simple and has a reduced cost.

14 Claims, 6 Drawing Sheets

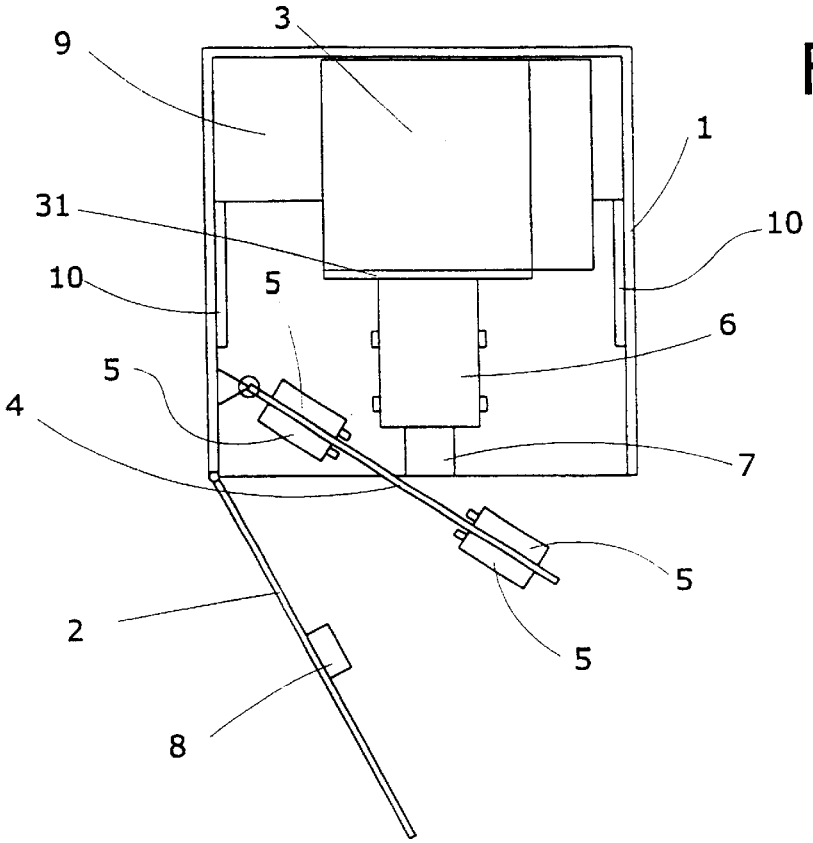
Fig.1
Fig.2
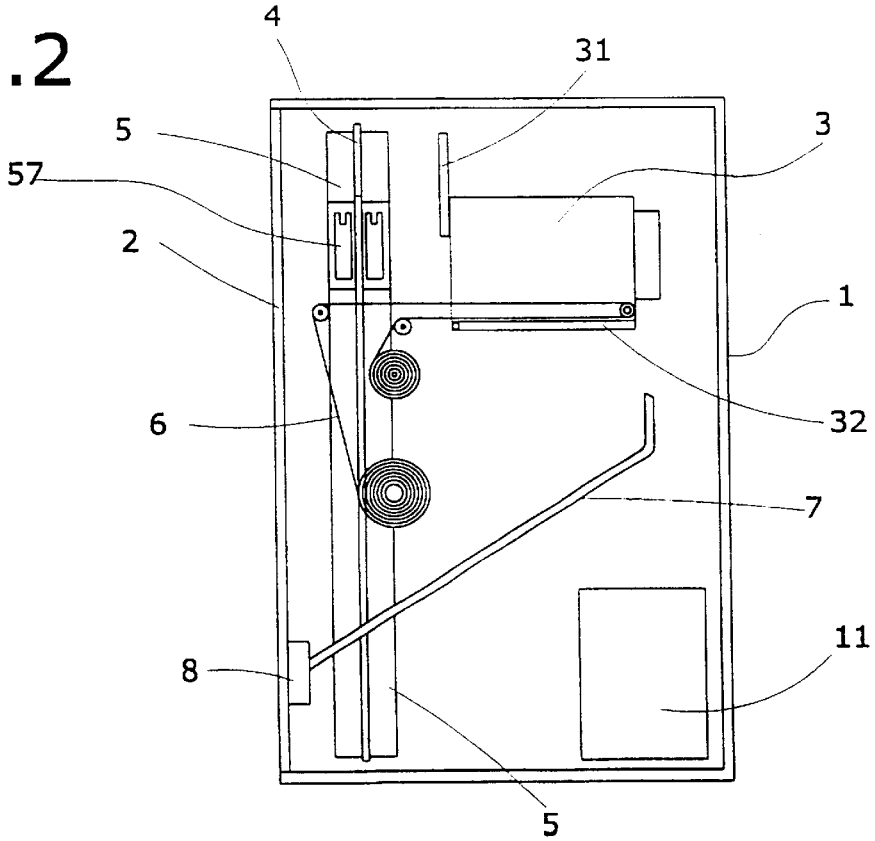

FOOD PRODUCTS DISTRIBUTOR

The present invention relates to a machine for dispensing food products, such as popcorn, of the type which processes the products in a microwave oven before supplying them. This machine includes a housing inside which is mounted a microwave oven, means for storing the products, means for feeding said products to the microwave oven, a device for controlling cooking of the products, and means for expelling the products from the oven.

BACKGROUND OF THE INVENTION

Known in the art, for example from Spanish patent application 9501495, upon which the preamble of claim 1 is based, are dispensing machines for food products which heat the products in a microwave oven before supplying them to the user.

These machines, though satisfactory in terms of their operation and the performance they offer, nevertheless have the disadvantage of not being very compact and of taking up a considerable amount of space, so that they cannot be installed in relatively small spaces.

This disadvantage is due to the complexity of the oven storage and loading/unloading mechanisms, which also make the cost of the machine relatively high.

WO-91/12597, which forms the basis for the preamble of claim 1, discloses a food dispenser with storage means, a conveyor band for the products and a microwave oven.

GB-2284805 also discloses a food dispenser, in which a rotating microwave oven discharges the cooked product by gravity from an opening on its cylindrical side wall.

DESCRIPTION OF THE INVENTION

This invention aims to resolve the aforementioned disadvantages, providing a machine for dispensing food products that is more compact than other known machines and that is low in cost.

In accordance with this aim, the machine for dispensing food products of the invention is as claimed in claim 1.

These characteristics allow the machine to be compact in structure, with much lower space occupation than in the prior art; moreover, simplification of the system for feeding and unloading the products reduces the cost of the materials and of the assembly of the machine.

Furthermore, these advantages are obtained without detriment to the reliability and versatility of the machine.

Expulsion of the product by tilting down the oven bottom simplifies still further the structure and fitting of the various mechanisms in the machine.

Preferably, the means of storage of the products are made up of a number of storage devices mounted on at least one frame articulated to the housing and provided with means for extracting the products through an outlet opening, said outlet opening being situated above the horizontal section of the band.

The articulated frame permits the storage devices to be placed in a favourable position for optimum distribution of the space available inside the housing, while at the same time permitting access to the oven and to the other mechanisms for the maintenance operations.

According to one particularly advantageous embodiment, each one of the storage devices includes a tape which forms a loop with its branches in vertical direction and to which are attached a plurality of plates between which the products are placed, the device being enclosed by a housing on which said outlet opening is provided.

This structure of the storage devices allows practically the entire height of the machine to be used for storage of the products.

In combination with this construction of the storage devices, the means for extraction of the products can include an inclined ramp in coincidence with the outlet opening.

Extraction of the products and supply thereof to the band is therefore implemented by a simple and reliable mechanism, which at the same time is of very low cost.

In an alternative embodiment, each of said storage devices comprises a vertical housing in which the products to be supplied are stacked, and said means of extraction of the products comprise a continuous belt with one or two associated thrust feet to push the top product from the stack through an outlet opening, while means are provided to raise the stack of products each time one of the products is supplied.

The means for raising the stack include in this case a vertical worm screw situated beside the housing, which is rotated in order to cause raising of a plate attached to the worm by means of an arm that passes through an elongate opening in the housing.

According to another alternative, each of said storage devices includes a vertical housing in which the products to be supplied are stacked, and in that said means for the extraction of products include a pair of spiral coils parallel to each other and inclined, which rotate in a synchronised manner to raise the products in horizontal position to reach an outlet opening through which they fall by gravity.

This embodiment is particularly suitable for very irregular products.

Advantageously, each frame is flat, with four of said storage devices mounted on it, two on either side, so that the two storage devices on one side of the frame are mounted on either side of the band, with their outlet openings facing each other.

With this configuration, each storage device discharges the corresponding product onto the band, without any need for other intermediate mechanisms.

In one embodiment of the invention, beneath the horizontal section of the conveyor band is mounted a weighing device, which permits secure detection of whether there is a product on the band.

Alternatively, the machine can include at least one detector to detect the fall of the product, and at least one detector to detect the entry of the product into the oven.

Preferably, the machine includes means for refrigerating at least one zone inside the housing. In this case, it is advisable that at least one of the frames includes thermal insulation means.

The interior of the housing is thus divided into a non-refrigerated zone, between the front door and the frame, in which popcorn or the like can be stored, and a refrigerated zone, behind the frame, for other products.

According to one variant, the conveyor band is made of paper and extends from a supply reel to a take-up reel; alternatively, it can be an endless band made of a plastic material.

BRIEF DESCRIPTION OF THE DRAWINGS

For a better understanding of what has been outlined, some drawings are attached which, schematically and solely by way of non-restrictive example, show a practical case of embodiment.

In said drawings:

FIG. 1 is a plan view of the machine of the invention, open;

FIG. 2 is a side elevation view of the machine, in operating position;

DESCRIPTION OF A PREFERRED EMBODIMENT

Figure 3:
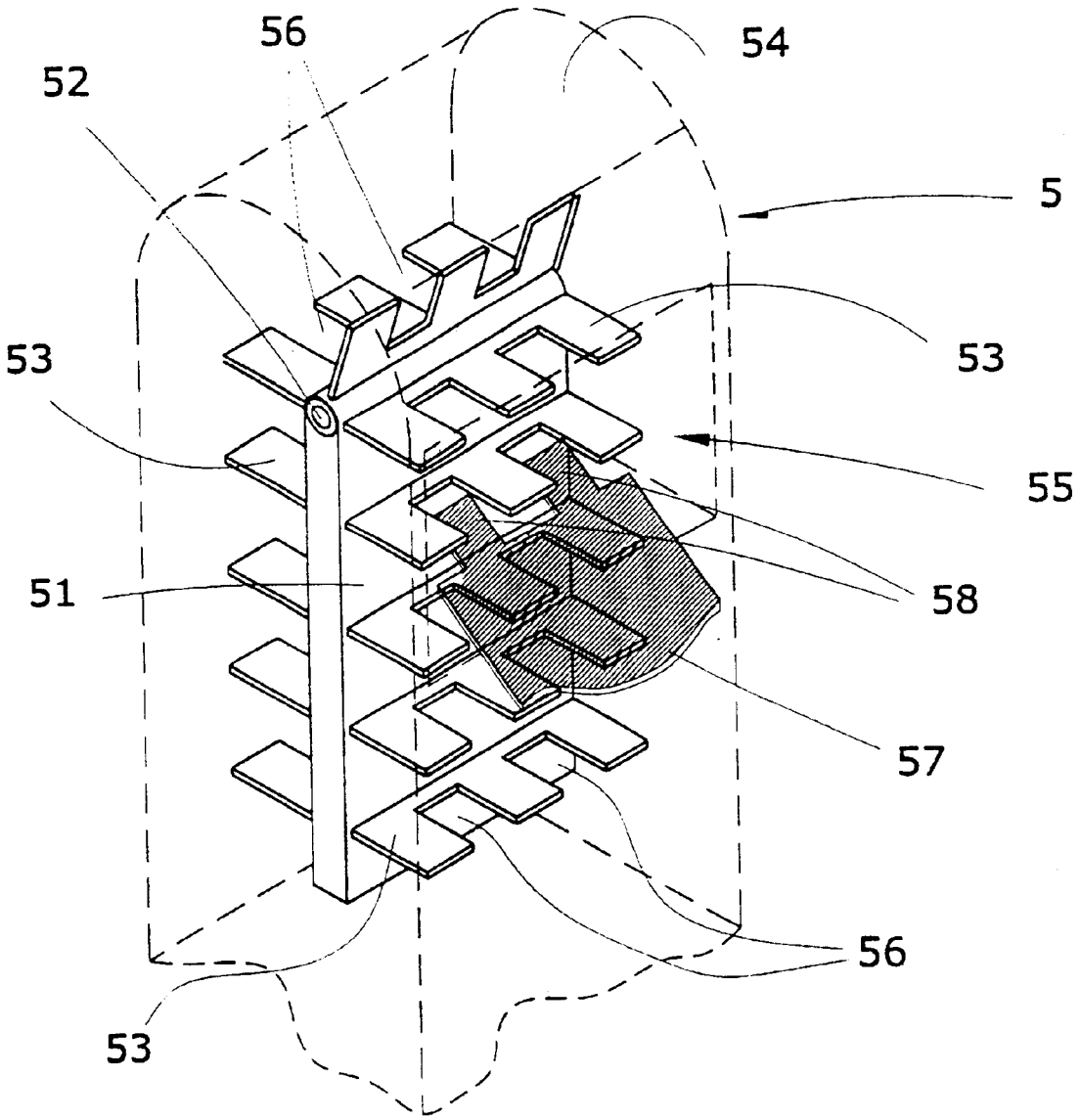
FIG. 3 is a perspective view of a detail of the storage device.

As shown in FIGS. 1 and 2, a machine in accordance with the invention has a housing 1, which is closed at its front part by a door 2, and which essentially contains:

- a microwave oven 3, provided with a front door 31 which can slide vertically, and a tilting bottom 32;
- a frame 4, of substantially flat configuration, hinged to the frame and supporting four storage devices 5 for the products P, two on either side;
- a paper band 6, which has the function of inserting the products into the oven through the door 31; and
- a supply channel 7 through which the product, which falls by gravity from the oven when the bottom 32 thereof tilts, is delivered on a tray 8 provided on the front door 2 of the machine, where the user can pick it up.

The machine is naturally provided also with all necessary control and safety elements for correct operation thereof (such as those described in the above cited patent), and a payment system by coins or card and a selector of the desired product.

In essence, the machine works as follows.

Initially, the oven 3 has its front door 31 open (raised), and the bottom 32 in the position that closes the bottom part of the oven.

When a user selects a product and makes the payment, the corresponding storage device 5 is set in movement and one of the products it contains falls on the paper band 6, in the manner which will be described below; the paper band advances until the product is placed inside the oven, the door 31 lowers and closes the oven and the heating cycle starts.

Figure 5:
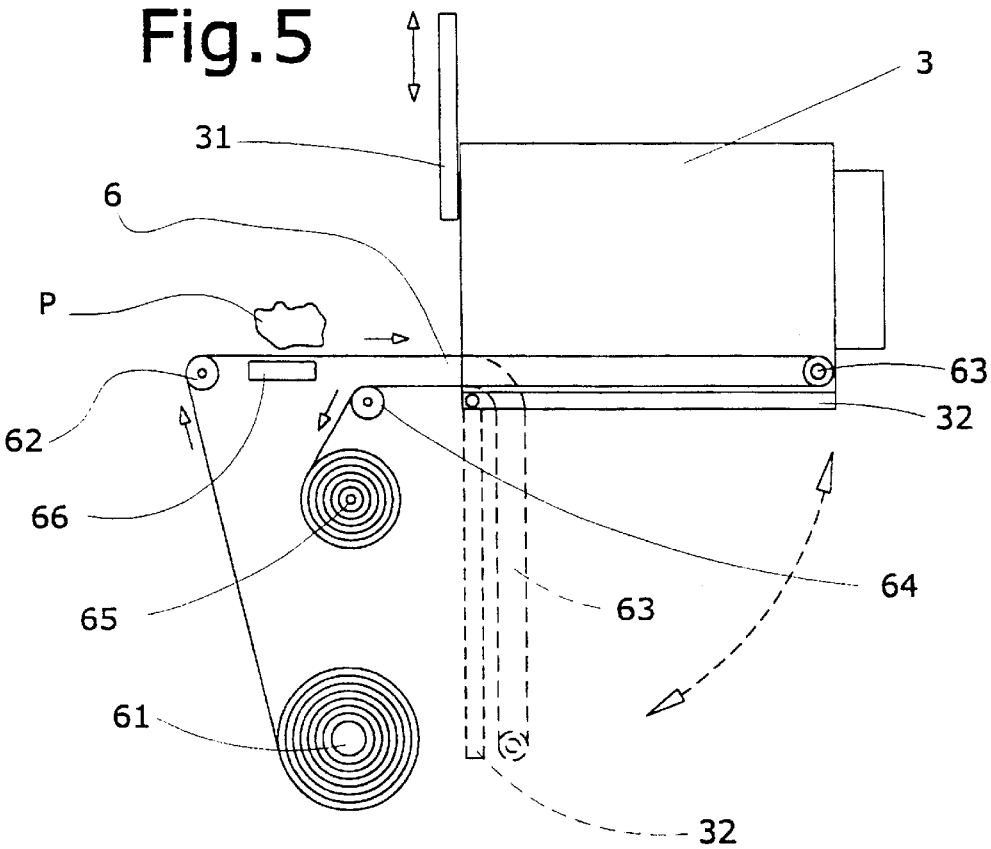
FIG. 5 is a side elevation view of the system for feeding products to the oven.

Once heating has finished, the bottom 32 of the oven is tilted downwards until it is left in the position shown in broken lines in FIG. 5, so that the product falls by gravity towards the supply channel 7, and the user can pick it up on the tray 8.

Finally, the bottom 32 closes again and the front door rises, leaving the machine ready for another operation.

It will be appreciated that the front door of the oven could also be hinged along its top side and open by tilting, since the only requirement is that it can close without damaging the conveyor band 6.

The most important mechanisms of the machine, that are the storage devices and the system for inserting the products in the oven, are described in greater detail below, with reference to FIGS. 3, 4 and 5.

Each one of the storage devices 5 is made up (FIG. 3) of a tape 51 that extends around a pair of rollers (one marked with reference number 52 in FIG. 3, while the other is not shown), fixed to the frame 4 in such a way that the tape is arranged vertically; a number of plates 53, between which the products to be supplied are placed, are articulated or otherwise attached onto the tape.

The device is closed off at its periphery with a housing 54, which prevents the products from falling laterally, while its upper part has an opening 55 through which the products are extracted in order to transfer them to the oven. As will be explained below, in order to permit this extraction each one of the plates 53 has a pair of parallel grooves 56.

As shown in FIG. 3, through the opening 55 of each storage device is mounted an inclined ramp 57 that is attached to the frame 4 in a position such that it interferes with the travelling path of the plates 53 of the storage device. One end of this ramp 57 has two parallel branches 58 for passing through the grooves 56 of the plates 53.

Figure 4:
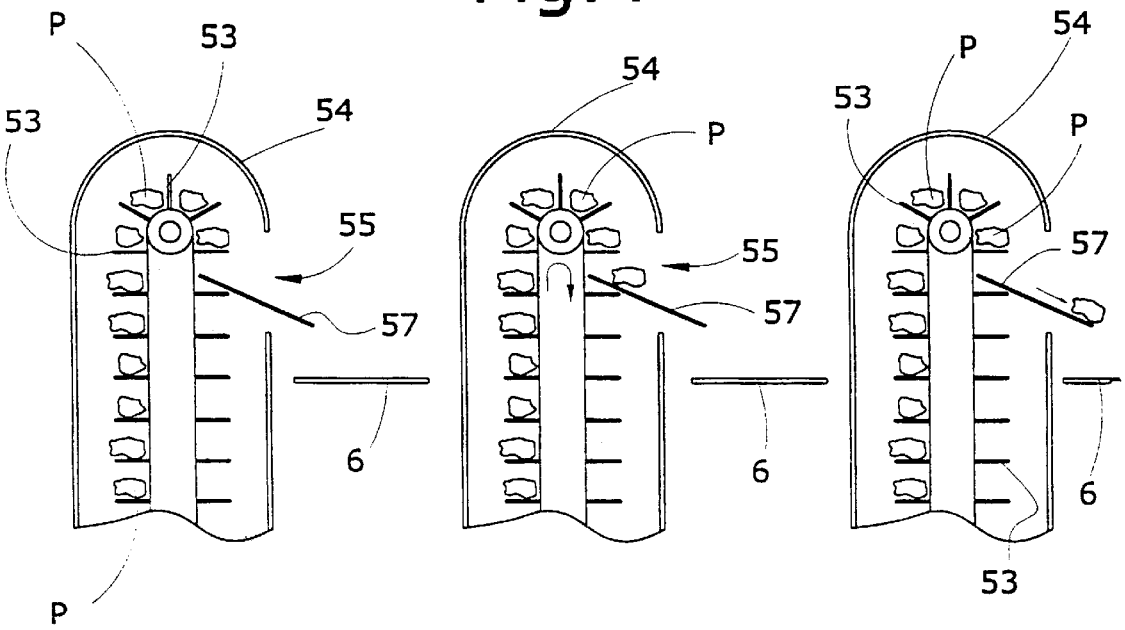
FIG. 4 shows schematically the process of extraction of a product from a storage device.

FIG. 4 shows schematically one of the driving devices 5 in three positions, representing the process of feeding a product to the band 6: when the tape 51 is set in motion by a corresponding driving mechanism (not shown), one of the plates 53 interacts in its downward movement with the ramp 57, in such a way that the product P that was on this plate is transferred to the ramp 57, and from there slides until it falls by gravity onto the paper band 6 arranged underneath.

Naturally, each storage device can contain a different product, selectable by the user.

In order to increase the number of storage devices it is sufficient to add other hinged frames, similar to the frame 4, each with another four storage devices.

The paper band 6 (FIG. 5) unrolls from a supply reel 61, passes over a return roller 62 and runs horizontally, passing for this purpose through an opening (not shown) in the frame 4.

The horizontal path of the paper band 6 passes between the storage devices 5, in such a way that it can collect the products which are supplied from any of the devices 5 via the corresponding ramp 57.

The band 6 runs horizontally until it reaches the back wall of the oven 3, where it passes around a second return roller 63 which is fixed to the tilting bottom 32 of the oven.

From here the band 6 emerges from the oven again, passes over another return roller 64 and is finally rolled on a take-up reel 65, which is also the band traction reel.

Under the horizontal section of the band 6 there is a weight sensor 66, which is used to detect the fall of a product on the band and to generate an "empty" notice where needed, for example if the advance of the corresponding storage device has been activated twice without the weight sensor having detected falling of the product.

When a product has fallen onto the band 6, the band is advanced until the product is left inside the oven, ready for heating.

As has been explained above, once the heating has finished the tilting bottom 32 of the oven opens until it is left in the position shown by a broken line in FIG. 5, so that the product falls in the supply channel 7. Since the roller 63 is mounted on the bottom of the oven, the paper band 6 is also let down following the movement of the bottom 32.

Both the oven 3 and the paper band 6 with their reels and rollers are mounted on a structure (of which only one shelf 9 for the oven is shown in FIG. 1) which can slide on horizontal guides 10 fixed to the housing 1, so that they can be partially extracted from the housing for cleaning and maintenance operations.

In order to avoid breakage of the paper band 6 when the bottom of the oven opens, the return roller 62 is mounted in such a way as to permit a certain amount of play, while at the same time maintaining the tension of the band, for example by means of a spring (not shown).

Naturally, the paper of the band 6 is food-grade paper of suitable strength; in this respect it should be noted that under the horizontal section of the band which remains outside the oven provision has been made for incorporating a supporting base, which has not been shown in order to avoid complicating the drawing, on which the weight sensor 66 would be fitted.

The door 2 and the frame 4 are provided with the openings necessary for the user to see the oven and for supply of the product, while the frame 4 also has an opening suitable for passage of the paper band 6.

The insertion band 6 could also be an endless band of a plastic material suitable for microwaves, such as Teflon (registered trade mark), mounted forming a closed loop, and which is therefore not used up each time a product is supplied and does not need to be replaced at intervals.

Optionally, it is foreseen that a part of the machine can be kept refrigerated in order to be able to supply perishable products; in this case, the frame 4 would include a thermally insulated sheet to insulate the interior of the housing 1 from the door 2; a compressor 11 for the refrigeration means could be located in the lower rear space in the machine (FIG. 2).

Non-refrigerated products, such as popcorn, would then be placed in the storage devices 5 situated on the side of the frame 4 facing towards the door 1, while products that require refrigeration, such as pizzas, waffles and the like, could be placed on the other side of the frame.

Figure 6:
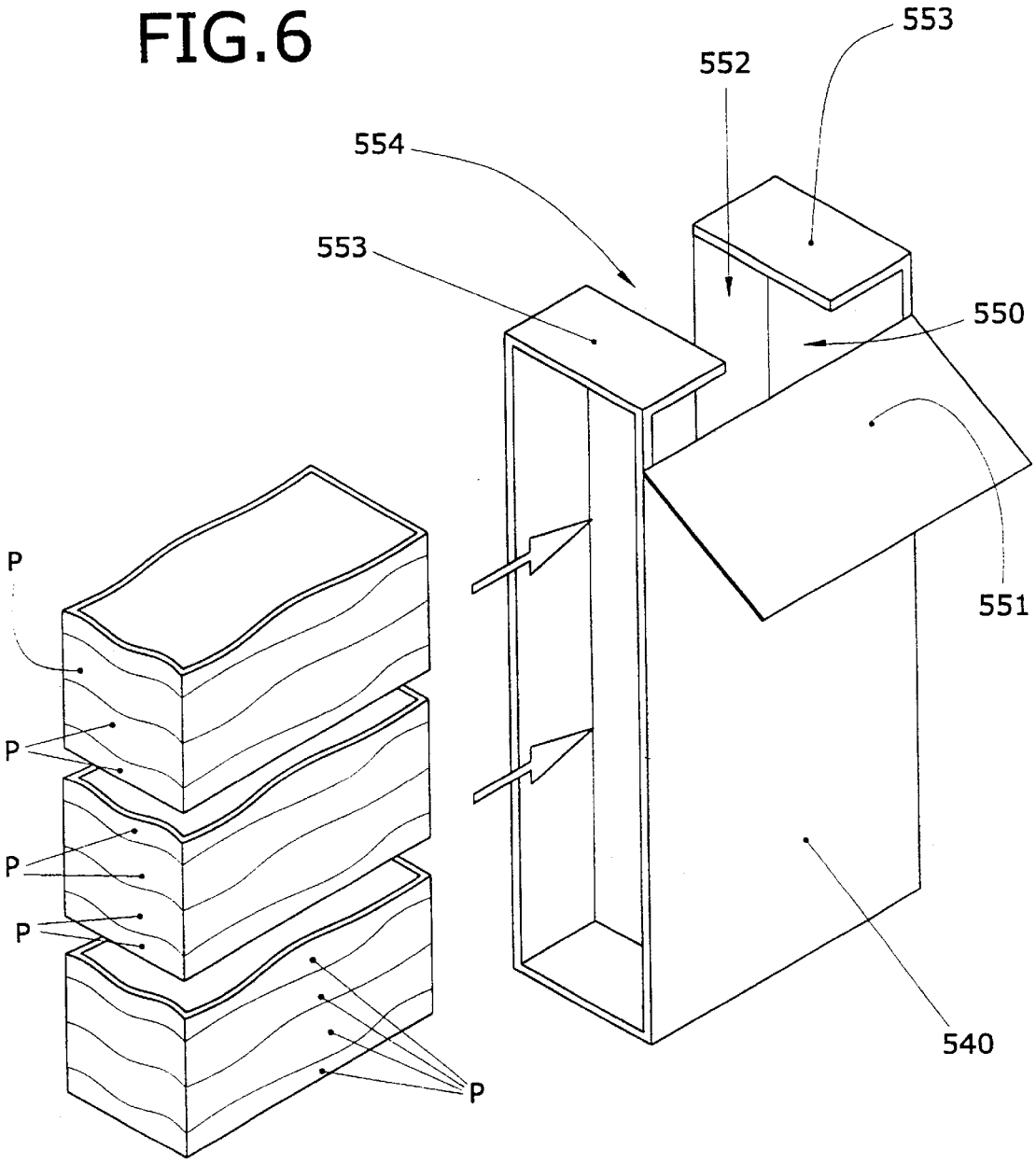
FIG. 6 is a perspective view of a second embodiment of a storage device.
Figure 7:
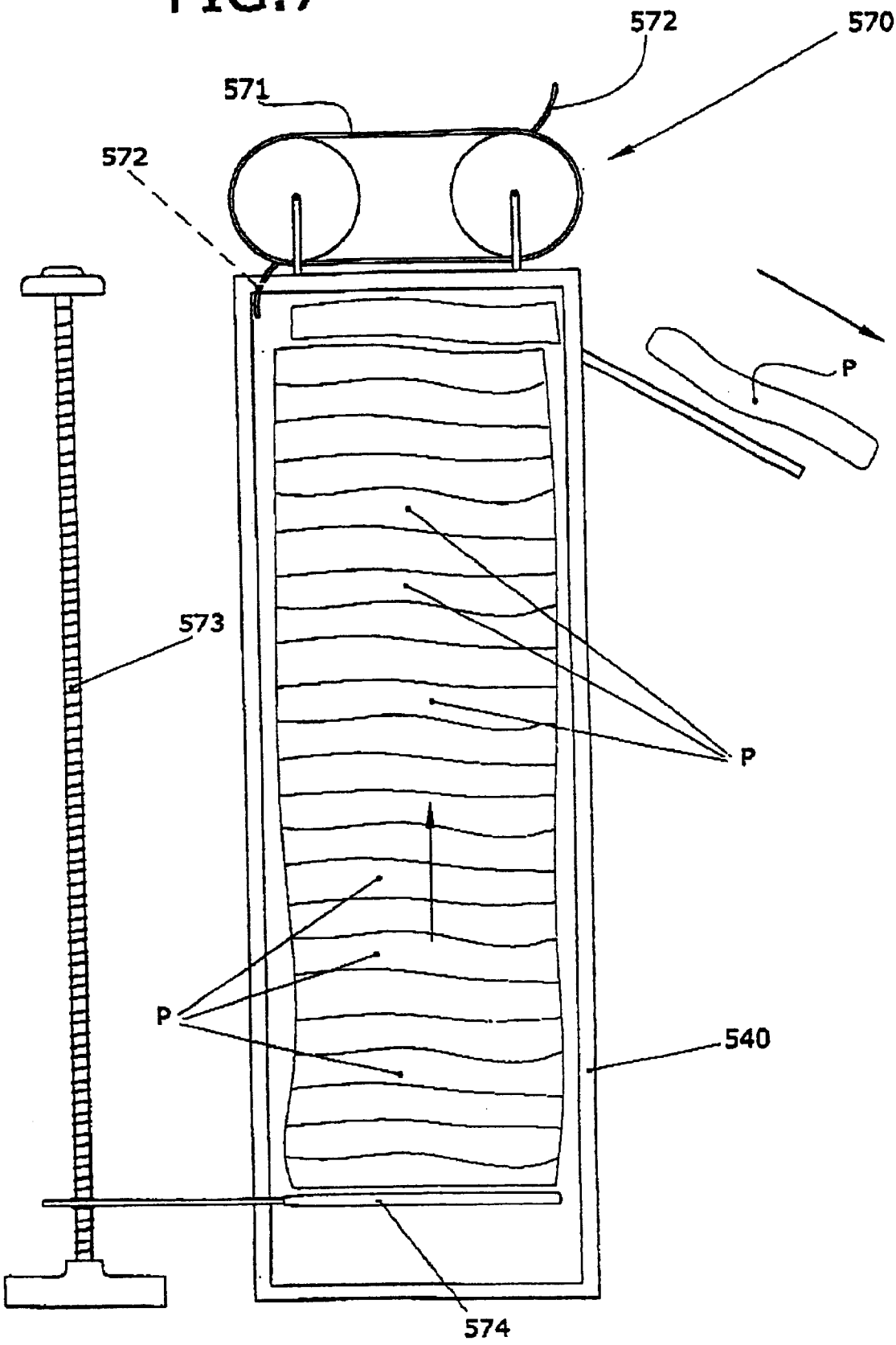
FIG. 7 is a section view along plane AA of FIG. 6, and showing also the elements necessary for expulsion of the bags from the storage devices.

FIGS. 6 and 7 show an alternative embodiment of the storage devices 5.

In this case, each storage device comprises a housing 540 in which the products P to be supplied, such as bags of popcorn, are stacked on top of each other. As FIG. 6 shows, the products P are inserted into the housing 540 through an open side thereof, preferably in the form of packages or blocks prepared in advance, since this simplifies the loading operation.

The housing 540 also has other openings: one outlet opening 550 on the top front part, adapted to the dimension of a bag or product to be supplied, beside which is fixed a ramp 551 for the fall of the product; an upper opening 552, formed between two upper stop lugs 553, through which, as will be seen below, an element of the product-extraction means acts; and an elongate rear opening 554, which extends along the entire height of the housing.

FIG. 7 shows the means 570 of extraction of the products from the storage housing: at the top part of the housing, over the opening 552, there is a continuous belt 571 with which one or two thrust feet 572 are associated, the feet performing the task of pushing the top bag from the stack through the outlet opening 550 and towards the ramp 551, when the belt is driven by a motor (not shown) in response to the user request for the product.

In order to make the products P (bags) advance upwards and keep a bag against the stop lugs 553, each storage device is also provided with a worm screw 573, which has attached to it a support plate 574 arranged under the stack of bags. The elongate opening 554 allows passage of the arm which holds the plate 574. Each time a bag is supplied the control means rotate the worm screw 573 and therefore raise the plate 574, and the stock of products P resting on it.

Microswitches (not shown) are fitted under the stop lugs 553 to detect the arrival of the next bag and stop the worm screw 573.

Furthermore, these microswitches detect that the bag is in completely horizontal position, which ensures secure expulsion.

The fall ramp 551 is fitted with a detector (not shown) having the function of informing the control means of the machine that the bag has been supplied to the insertion band 6, so that the band is set in motion. The system is complemented by a photocell (not shown) for detecting entry of the bag into the oven, which causes it to close and start to operate. In this case, no weighing scale or weight sensor need be provided under the band 6.

Figure 8:
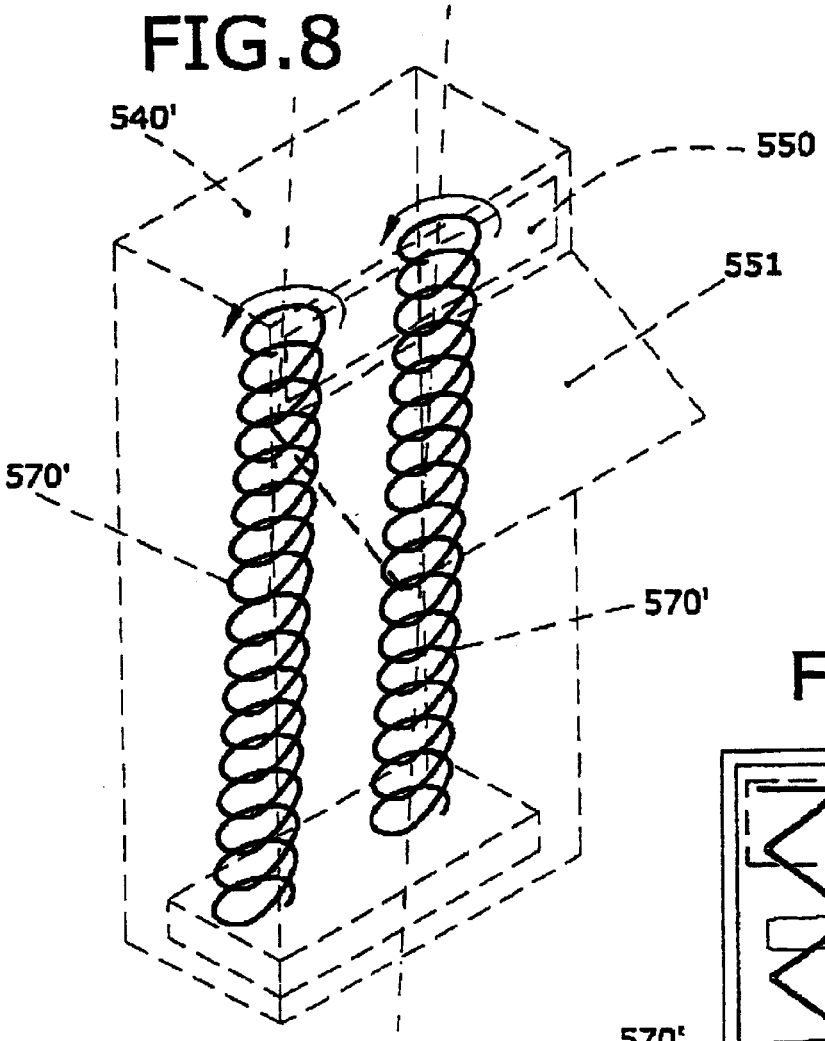
FIGS. 8 and 9 are highly schematic perspective and elevation views, respectively, of a third embodiment of a storage device, with its product-expulsion elements.
Figure 9:
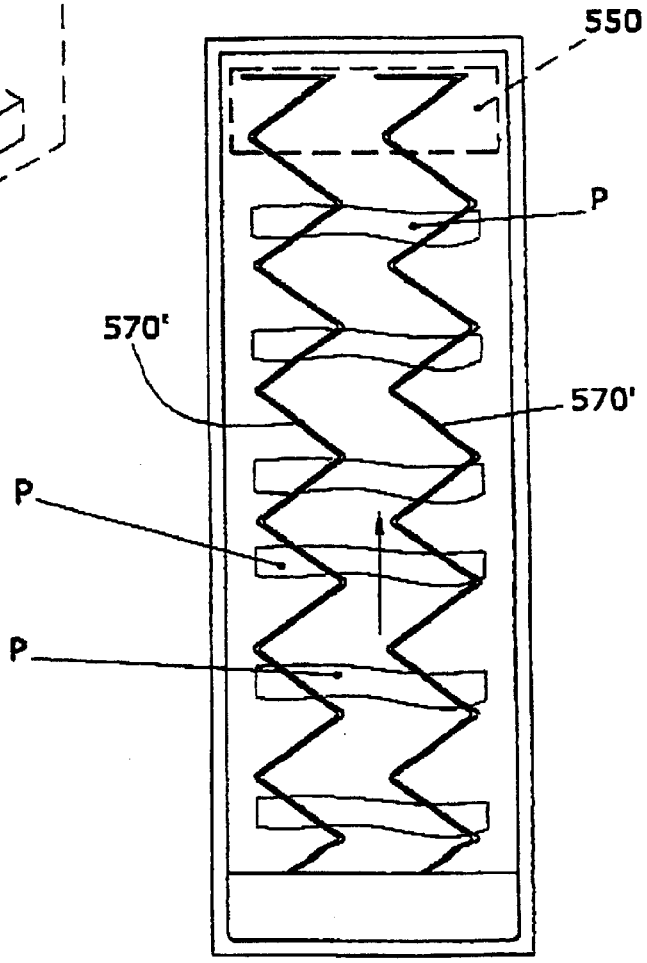

Another alternative means of embodiment of the means of extraction of the products from the housing is shown schematically in FIGS. 8 and 9. As can be seen, in this case the interior of the housing 540' has a pair of spiral coils of the type using in other vending machines for advance of the product. Each one of the bags of popcorn P or the like is placed between the two spiral coils, which rotate in a synchronised manner to make the bags rise horizontally; there is one bag in each spire of the coils. The placement of the bags has been shown in the view of FIG. 5.

When a bag reaches the outlet opening 550, it falls by gravity and slides along the ramp 551; the spiral coils are inclined at an angle to ensure this expulsion by gravity.

This embodiment with spiral coils is particularly suitable in the case of products P of highly irregular shape.

Another remarkable feature of the machine of the invention is the system for control of the cooking time.

The time needed to heat up each type of food depends, amongst other things, on factors that are difficult to monitor, such as the outer temperature or the wear of the oven magnetron; it is therefore not advisable to set a fixed time for each product to remain in the oven, because under some circumstances that time may be insufficient. In the case of popcorn, some control systems are based on acoustic detection of bursting of the grains of corn: after the start of bursting has been detected, operation of the oven is halted once the interval between bursts exceeds a certain time, because practically all the grains are then considered to have burst.

This method is undoubtedly effective, but is complex and costly; what is more, it only allows to determine the time that popcorn should remain in the oven, but it is not useful for other products.

In the machine of the invention, the system for the control of cooking times is much simpler, although at the same time it allows account to be taken of the above mentioned factors of magnetron wear and the like, and is used for all the products supplied by the machine.

The method is now described: it is based on the fact that popcorn requires a certain heating time before the grains begin to burst, this time depending on environmental conditions and on the oven, while the time then remaining until nearly all the popcorn has burst varies little, so that from that time onwards a fixed additional heating time can be applied.

The machine is provided with an acoustic sensor to detect the bursting of the corn grain, situated inside the oven, with the necessary filters, as in the prior art, which is used to find out when the first stage of heating (variable) has been completed.

The machine is programmed initially with some basic or reference heating times for each product, which can for example be determined before installing the machine.

Each time the user requests supply of popcorn, the machine control means determine, on the basis of the signals from the acoustic sensor, the time at which the first phase of heating has been completed and the popcorn grains have begun to burst (when, for example, the sensor has detected three bursts in one second), and apply an additional, fixed and predetermined oven preparation time.

At the same time, the control means compare the time of the first phase of heating, or else the total time of cooking of the popcorn, with the reference time, and by means of a simple proportion automatically adjust the heating time of all the other products supplied by the machine.

As can be seen, this system is extremely simple but does permit periodic control and adjustment of the times for all the products to take account of variations of exterior and oven conditions.

As is natural, this cooking control system could be applied to any machine for dispensing food products, independently of the configuration of the means of storage, supply and extraction of the products.

Despite the fact that the drawings describe and show a preferred embodiment of the machine object of the invention, it is obvious that an expert in the field could incorporate variants and modifications, in accordance with the specific requirements of each case, and that all the technical details could be replaced by other equivalent details, without departing from the scope of protection defined by the attached claims.

What is claimed is:

1. A machine for dispensing food products (P) comprising a housing (1) inside which is mounted a microwave oven (3), means (5) for storing products (P), means (6) for feeding said products to the microwave oven, a device for controlling cooking of the products, and means for expelling (32) the products from the oven, the oven having a front insertion door (31) that can slide vertically or is hinged along its upper side, and in that said means for feeding the products to the oven including a conveyor band (6) with at least one horizontally traveling section, so that the products fall on said conveyor band by gravity from the storage means (5), said horizontal section extending as far as the interior of the oven (3), wherein the oven also comprises a tiltable bottom (32), which constitutes the means of expulsion of the products, while said conveyor band (6) passes around a return roller (63) mounted on said tiltable bottom (32).

2. A machine as claimed in claim 1, wherein the means for storage of the products are made up of a number of storage devices (5) mounted on at least one frame (4) articulated to the housing (1) and provided with means (57, 570, 570') for extracting the products through an outlet opening (55, 550), said outlet opening (55, 550) being situated above the horizontal section of the conveyor band.

3. A machine as claimed in claim 2, wherein each of said storage devices (5) includes a tape (51) which forms a loop, with its branched in vertical direction, and to which are attached a plurality of plates (53) between which the products are placed, the device being enclosed by a housing (54) on which said outlet opening (55) is provided.

4. A machine as claimed in claim 3, wherein the means for extraction of the products include an inclined ramp (57) in coincidence with the outlet opening (55).

5. A machine as claimed in claim 2, wherein each of said storage devices (5) comprises a vertical housing (540) in which the products (P) to be supplied are stacked, and in that said means for extraction of the products comprise a continuous belt (571) with on or two associated thrust feet (572) to push top product from the stack through an outlet opening (550), while means (573, 574) are provided to raise the stack of products each time one of the products is supplied.

6. A machine as claimed in claim 5, wherein said means for raising the stack include a vertical worm screw (573) arranged beside the housing, which is rotated in order to cause raising of a plated (574) attached to the worm (573) by means of an arm that passes through an elongate opening (554) in the housing (540).

7. A machine as claimed in claim 5, wherein it includes at least one detector to detect the fall of the products, and at least one detector to detect the entry of the products into the oven.

8. A machine as claimed in claim 2, wherein each of said storage devices (5) includes a vertical housing (540) in which the products (P) to be supplied are stacked, and in that said means for the extraction of products include a pair of spiral coils (570') parallel to each other and inclined, which rotate in a synchronized manner to raise the products in horizontal position to reach an outlet opening (550) through which they fall by gravity.

9. A machine as claimed in claim 2 wherein each frame (4) is flat, with four of said storage devices (5) mounted on it, two on either side, so that the two storage devices (5) on one side of the frame are mounted on either side of the conveyor band (6), with their outlet openings (55, 550) facing each other.

10. A machine as claimed in claim 1, wherein beneath the horizontal section of said conveyor band (6) is mounted a weighing device (66).

11. A machine as claimed in claim 1, wherein it includes means for refrigerating (11) at least one zone inside the housing (1).

12. A machine as claimed in claim 11 wherein characterised in that at least one of the frames (4) includes thermal insulation means.

13. A machine as claimed in claim 1 wherein the conveyor band (6) is made of paper and extends from a supply reel (61) to a take-up reel (65).

14. A machine as claimed in claim 1, wherein the conveyor band (6) is an endless band made of a plastic material.

* * * * *